US006997802B2

(12) United States Patent
Gauselmann

(10) Patent No.: US 6,997,802 B2
(45) Date of Patent: Feb. 14, 2006

(54) GAMING DEVICE WITH RANDOMLY DETERMINED GAME FIELD

(75) Inventor: Michael Gauselmann, Espelkamp (DE)

(73) Assignee: Atronic International GmbH, Lübbecke (DE)

( * ) Notice: Subject to any disclaimer, the term of this patent is extended or adjusted under 35 U.S.C. 154(b) by 90 days.

(21) Appl. No.: 10/256,180

(22) Filed: Sep. 25, 2002

(65) Prior Publication Data

US 2003/0064766 A1 Apr. 3, 2003

(30) Foreign Application Priority Data

Sep. 28, 2001 (DE) ..... 101 48 126

(51) Int. Cl.
*A63F 9/24* (2006.01)

(52) U.S. Cl. ..... 463/15; 273/248; 273/275; 463/16

(58) Field of Classification Search ..... 463/9, 463/15, 16; 273/275, 248
See application file for complete search history.

(56) References Cited

U.S. PATENT DOCUMENTS

| | | | | |
|---|---|---|---|---|
| 3,404,889 | A * | 10/1968 | Warner, III | 273/237 |
| 3,516,671 | A * | 6/1970 | Estrin | 273/238 |
| 4,240,638 | A * | 12/1980 | Morrison et al. | 463/15 |
| 4,465,283 | A * | 8/1984 | Pilette et al. | 273/249 |
| 5,333,878 | A * | 8/1994 | Calhoun | 273/283 |
| 6,347,995 | B1 * | 2/2002 | Igarashi et al. | 463/15 |
| 6,659,464 | B1 * | 12/2003 | Champion et al. | 273/292 |

FOREIGN PATENT DOCUMENTS

DE 3702134 A1 * 8/1988

OTHER PUBLICATIONS

Dyer, Jason. "Generating random mazes". Feb. 20, 2001 [online], [retrieved on Apr. 28, 2004] Retreived from the Internet: URL:<http://fly.cc.fer.hr/GDM/articles/maps/rmaze.html>.*

Translation of DE 37 02 134 A1 "Coin-Operated Gaming Machine", Mulder et al. Aug. 4, 1988.*

Dyer, Jason. "Generating random mazes". Feb. 20, 2001 [online], [retrieved on Apr. 28, 2004] Retreived from the Internet: URL:<http://fly.cc.fer.hr/GDM/articles/maps/rmaze.html>.*

Translation of DE 37 02 134 A1 "Coin-Operated Gaming Machine", Mulder et al. Aug. 4, 1988.*

"Blockbusters", The Original Game $how PAge! [online] Retrieved on Apr. 24, 2002. URL:<http://www.chris-lambert.com/RULES/Blockbusters.html.*

Abstract of German Patent No. DE 37 02 134 C2, 1 page.

* cited by examiner

*Primary Examiner*—Julie Brocketti
(74) *Attorney, Agent, or Firm*—Patent Law Group LLP

(57) ABSTRACT

A gaming device displays a game field with a start field and a target field separated by at least one field. The number of fields separating the start field from the target field is determined for each play of the game by, for example, a pseudo random number generator. In some embodiments, the game field has multiple start fields and multiple target fields that may change position in the game field with each play of the game. An indicator randomly selects the number of moves for the player and a virtual player in competition with the actual player. The object of the game may be for the player to reach a target field before the gaming machine virtual player reaches a target field. An award may be based on the player reaching the target field before the virtual player.

21 Claims, 2 Drawing Sheets

GAMING DEVICE WITH RANDOMLY DETERMINED GAME FIELD

FIELD OF INVENTION

The invention is related to a method performed by a gaming device to determine the layout of a game field on a video screen comprising a plurality of fields connecting with at least one start field and at least one target field.

BACKGROUND

German Application No. 37 02 134 C2 teaches a coin-operated gaming machine with a graphic processor that displays a grid of fields (spaces or positions), including a starting field and multiple target fields. The object of the game is to light a path of fields from the starting field to a target field. The number of fields a player can light in each turn is determined by a random number generator, and the path of the lights can be changed at predetermined nodal points by the player pressing buttons that control the direction of the path. The available paths between the start field and the target fields can not be changed, causing monotony in the game, which reduces the appeal of the gaming machine to players.

SUMMARY

In accordance with embodiments of the device, a game field with a start field and a target field separated by at least one field is provided. The number of fields separating the start field from the target field is determined for each play of the game by, for example, a pseudo random number generator. In some embodiments, the gaming field has multiple start fields and multiple target fields which may change position in the gaming field with each play of the game.

DETAILED DESCRIPTION

Figure 1:
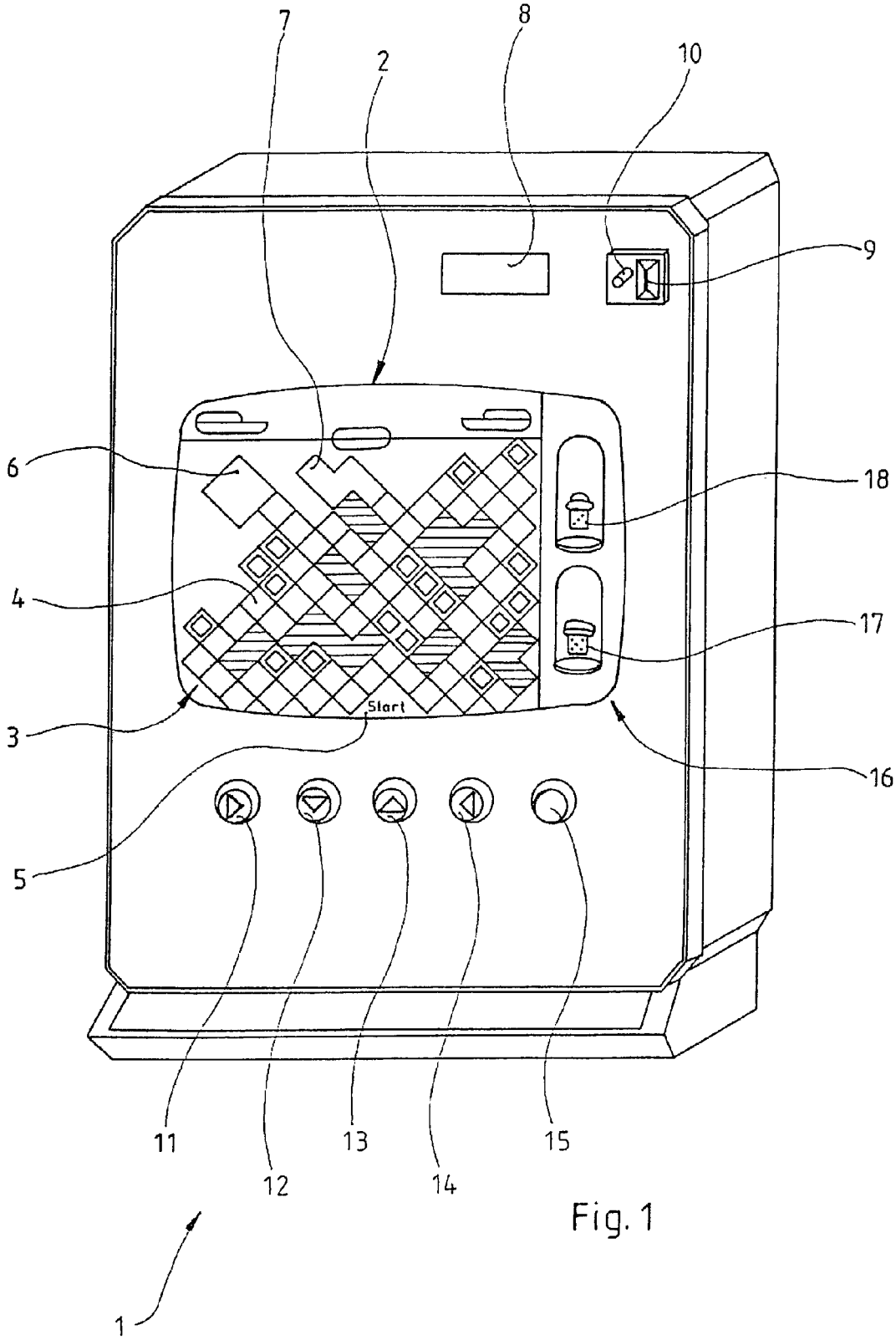
FIG. 1 is a front view of a gaming machine.

FIG. 1 illustrates a gaming machine according to embodiments of the present invention. Gaming machine 1 comprises a display 2, which may be, for example, a CRT, a thin film transistor (TFT) display, or any other suitable display. A region 3 which looks like a street map is displayed on display 2. The street map comprises different colored fields 4, starting field 5, and at least one target field 6, 7. Above main display 2, a credit meter display 8 displays the number of credits available to the player. Also above main display 2 is a coin slot 9 with a reject button 10. Other devices for accepting cash or credit may be used instead of or in addition to coin slot 9, including, for example, bill readers, credit card readers, and smart card readers. Below main display 2 are control elements 11–15 connected to a control unit including, for example, a microprocessor. The game is played by the player pressing control elements 11–15, as described below. Next to region 3 are indicators 17 and 18, which indicate how many fields light up for each of the player's and the gaming machine's turns. Indicators 17 and 18 may be, for example, actual dice, a video version of dice, a spinner, or any other type of indicator.

A coin tray at the bottom of machine 1 receives an award paid out to the player upon the player reaching a target field before the gaming machine reaches a target field.

The game is played as follows. The player begins the game by inserting coins into coin slot 9. After the game is started by the player and before the first play, a pseudo random number generator determines for that particular play of the game the number of fields 4 between start field 5 and target fields 6, 7 from a predetermined or infinite range of fields. There may be multiple start fields 5, and the player and the gaming machine may start at different start fields. Each time the game is played, the number of fields 4 between start field 5 and target fields 6, 7 is determined by the pseudo random number generator. Region 3 displays the street map determined by the pseudo random number generator.

Fields 4 are spaces or steps between start field 5 and target fields 6, 7. The available paths between start field 5 and target fields 6, 7, including the number and location of nodal points where the path can change directions, may change each time the game is played. The position of the target fields may change with each game along with the number of fields 4 between start field 5 and target fields 6, 7. The position of start field 5 may be constant or may change each time the game is played. Between each start field 5 and each of target fields 6, 7 there may be the same or a different number of fields 4.

The player and the gaming machine alternate turns during the game. The player presses button 15, causing the pseudo random number generator of the control unit to determine values displayed by indicators 17, 18. One of the indicators 17, 18 indicates the number of fields 4 that may be illuminated by the player during her turn, and the other of the indicators 17, 18 indicates the number of fields 4 that may be illuminated by the gaming machine during its turn. The player controls which fields 4, starting from start field 5, are illuminated during her turn by pressing control elements 11–14. In the example of FIG. 1, the control elements 11–14 are arrows that allow the player to select the direction of the illumination of fields 4 after each turn or at appropriate points in the game field.

After the player has illuminated the number of fields designated by indicator 17, the gaming machine 1 then illuminates the number of fields indicated by indicator 18 beginning from start field 5. The player tries to reach one of target fields 6, 7 in the fewest number of turns and before the gaming machine reaches one of target fields 6, 7, in order to be granted an award by machine 1.

The number of fields traveled by the player need not be indicated by illuminating the fields and may be indicated in any other suitable way.

The game described herein may be the main game in a gaming machine or may be a bonus game that is initiated upon a certain outcome of the main game, such as a certain combination of symbols.

Figure 2:
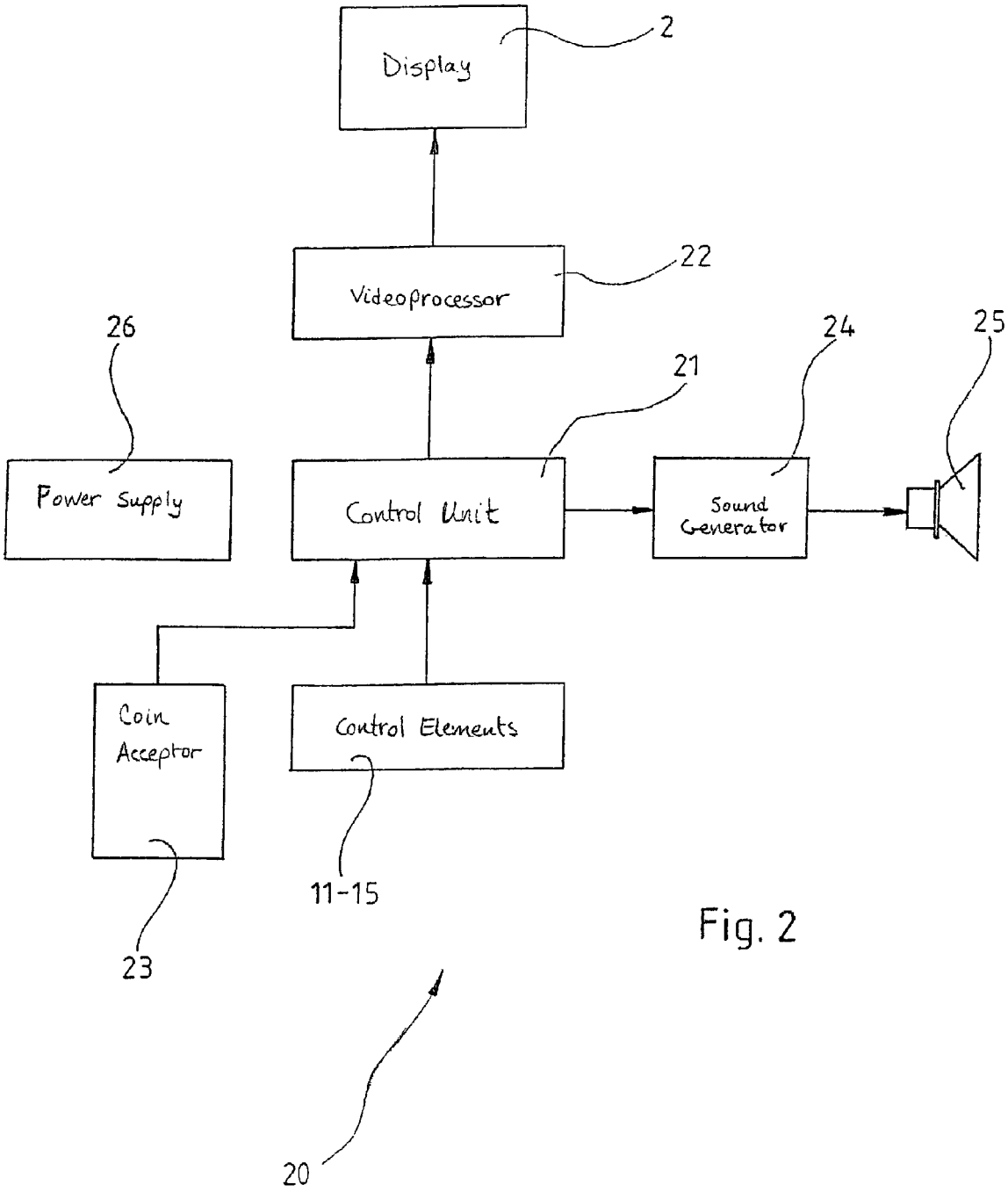
FIG. 2 is a diagram of functional blocks in a gaming machine.

FIG. 2 illustrates function blocks in a gaming machine for use with the present invention. The gaming machine has a control unit 21 which includes, for example, a microprocessor and a pseudo random number generator. The pseudo random number generator may be separate from or part of the microprocessor. In response to receiving the required number of coins in coin acceptor 23, the pseudo random number generator determines the number of fields between each start field and each target field. Any suitable device for accepting cash or credit may be used instead of a coin acceptor. Once the number of fields 4 between the start fields and the target fields is determined, video processor 22 determines a screen for that particular play of the game, then communicates the screen to display 2. The possible screens having the randomly selected number of fields are either stored in a memory or are created in real time.

The player plays the game by pressing control elements 11–15, which are received by control unit 21 and used to instruct video processor 22 to change display 2, if necessary, by, for example, illuminating the fields selected by the player.

A sound generator 24 and speaker 25 may be connected to control unit 21 for generating sound during play of the game or during periods when the game is not played to attract players to the gaming machine. A power supply 26 provides the power for the gaming machine 1.

The game may be played on a stand-alone gaming machine, a monitor remotely connected to a server, a home computer playing a gaming program, or on any other suitable device.

While particular embodiments have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method performed by a gaming device comprising:

selecting a number of fields, from a range of fields, separating a start field and a target field prior to each play of a game on a game field, such that the game field is changed depending on the number of fields selected prior to each play of a game;

displaying the selected game field comprising the start field, the target field, and a plurality of fields separating the start field and the target field;

carrying out play of a game where a player moves through the fields towards the target field based on the result of an indicator; and selecting by an indicator during a single indicating event a number of fields, including a plurality of fields, moved by the player during a single move by the player, wherein subsequent moves require additional selections by the indicator.

2. The method of claim 1 wherein a pseudo random number generator determines the number of fields separating the start field and the target field.

3. The method of claim 2 wherein the pseudo random number generator selects the number of fields from a predetermined range of numbers of fields.

4. The method of claim 1 further comprising selecting a position of the start field in the game field prior to each play of a game on the game field.

5. The method of claim 1, wherein the target field can be moved within the game field to any one of a plurality of positions, the method further comprising selecting a displayed position of the target field in the game field prior to each play of a game on the game field.

6. The method of claim 1 wherein:

the target field is a first target field;

the game field further comprises a second target field; and a number of fields separating the start field from the first target field is different from a number of fields separating the start field from the second target field.

7. The method of claim 1 wherein:

the target field is a first target field;

the game field further comprises a second target field; and a number of fields separating the start field from the first target field is the same as a number of fields separating the start field from the second target field.

8. The method of claim 1 wherein the start field is a first start field, and the game field further comprises a second start field.

9. The method of claim 1 further comprising:

receiving an indication of fields in the game field to illuminate; and illuminating the indicated fields on the displayed game field to show progress toward the target field.

10. The method of claim 1 wherein a position of the start field in the game field is constant for multiple plays of a game on the game field.

11. The method of claim 1 further comprising determining at least one path of fields between the start field and the target field prior to each play of a game on the game field.

12. The method of claim 1 further comprising granting an award to the player based on the player reaching the target field.

13. A gaming device comprising:

a display; and at least one processor programmed to carry out the following method:

receiving an indication to start a game;

selecting a number of fields, from a range of fields, to separate a start field and a target field on a game field, such that the game field is changed depending on the number of fields selected prior to each play of a game;

displaying the game field on the display;

carrying out play of a game where a player moves through the fields towards the target field based on the result of an indicator; and selecting by an indicator during a single indicating event a number of fields, including a plurality of fields, moved by the player during a single move by the player, wherein subsequent moves require additional selections by the indicator.

14. The device of claim 13, wherein the target field can be moved within the game field to any one of a plurality of positions, and wherein the processor is further programmed to select a displayed position on the game field of the target field.

15. The device of claim 13 wherein the processor is further programmed to select a position on the game field of the start field.

16. The device of claim 13 further comprising a pseudo random number generator for determining a number of fields to separate the start field and the target field on the game field.

17. The device of claim 13 wherein selecting a number of fields to separate a start field and a target field on a game field occurs after receiving an indication to start a game.

18. The device of claim 13 further comprising the at least one processor further programmed to carry out the following method:

alternating between the player taking a turn moving a number of fields determined by the indicator and the at least one processor, represented on the game field separate from the player, taking a turn moving a number of fields determined by an indicator.

19. The device of claim 18 further comprising the at least one processor further programmed to carry out the following method:

granting an award to the player for reaching the target field before the at least one processor reaches the target field.

20. The method of claim 1 further comprising:

alternating between the player taking a turn moving a number of fields determined by the indicator and a processor, represented on the game field separate from the player, taking a turn moving a number of fields determined by an indicator.

21. The method of claim 20 further comprising:

granting an award to the player for reaching the target field before the processor reaches the target field.

* * * * *